US009808909B2

(12) United States Patent
Nambiath et al.

(10) Patent No.: US 9,808,909 B2
(45) Date of Patent: Nov. 7, 2017

(54) ORIFICE FOR A WATERJET CUTTER

(71) Applicant: KMT Waterjet Systems Inc., Baxter Springs, KS (US)

(72) Inventors: Pradeep Nambiath, Rogers, AR (US); David S. Wootton, Joplin, MO (US)

(73) Assignee: KMT Waterjet Systems Inc., Baxter Springs, KS (US)

( * ) Notice: Subject to any disclaimer, the term of this patent is extended or adjusted under 35 U.S.C. 154(b) by 321 days.

(21) Appl. No.: 14/158,919

(22) Filed: Jan. 20, 2014

(65) Prior Publication Data

US 2015/0202740 A1 Jul. 23, 2015

(51) Int. Cl.
*B24C 5/04* (2006.01)
*B24C 1/04* (2006.01)
*B05B 1/00* (2006.01)

(52) U.S. Cl.
CPC ..... *B24C 5/04* (2013.01); *B05B 1/00* (2013.01); *B24C 1/04* (2013.01); *B24C 1/045* (2013.01)

(58) Field of Classification Search
CPC .. B24C 1/04; B24C 1/045; B24C 5/04; B05B 1/00
USPC ..... 451/102
See application file for complete search history.

(56) References Cited

U.S. PATENT DOCUMENTS 2,413,167 A * 12/1946 Bugley ..... B24C 5/04 451/102
4,640,375 A * 2/1987 Barr ..... E21B 10/602 175/431
4,676,324 A * 6/1987 Barr ..... E21B 10/602 175/385
5,439,492 A * 8/1995 Anthony ..... C23C 16/01 239/DIG. 19
6,425,805 B1 * 7/2002 Massa ..... B24C 5/04 239/433
2003/0189114 A1 * 10/2003 Taylor ..... B05B 1/00 239/602
2004/0132389 A1 * 7/2004 Miller ..... B24C 11/005 451/101

(Continued)

FOREIGN PATENT DOCUMENTS

EP 1539362 1/2010
EP 1963051 2/2011

(Continued)

OTHER PUBLICATIONS

International Search Report and Written Opinion for PCT Application No. PCT/US2015/011116 dated Apr. 28, 2015 (15 pages).

*Primary Examiner* — Eileen Morgan
(74) *Attorney, Agent, or Firm* — Michael Best & Friedrich LLP

(57) ABSTRACT

An orifice for a high-pressure waterjet cutter includes a first surface defining an inlet plane, a second surface defining an outlet plane, and an inner bore aligned along a flow axis and extending from the first surface to the second surface. The orifice also includes a first layer of polycrystalline diamond extending from the first surface to a plane between the inlet plane and the outlet plane, and a second, separate layer of polycrystalline diamond extending from the plane to the second surface. The first layer and the second layer are coupled to one another to define a single component. The second layer has material properties different than the first layer.

17 Claims, 4 Drawing Sheets

(56) References Cited

U.S. PATENT DOCUMENTS

| | | | | |
|---|---|---|---|---|
| 2006/0124772 | A1* | 6/2006 | Pourdeyhimi | D04H 18/04 239/533.14 |
| 2009/0258582 | A1* | 10/2009 | Miller | B24C 1/045 451/102 |
| 2010/0088894 | A1* | 4/2010 | Stark | B24C 1/045 29/890.142 |
| 2010/0146865 | A1 | 6/2010 | Sato et al. | |
| 2012/0238188 | A1* | 9/2012 | Miller | B24C 1/045 451/75 |
| 2014/0004776 | A1* | 1/2014 | Bury | B24C 1/045 451/102 |

FOREIGN PATENT DOCUMENTS

| | | | |
|---|---|---|---|
| EP | 2509750 | | 10/2012 |
| JP | 2013028500 | A | 2/2013 |
| WO | 02096567 | A1 | 12/2002 |
| WO | 2009154567 | A1 | 12/2009 |
| WO | 2011070154 | | 6/2011 |

* cited by examiner

ORIFICE FOR A WATERJET CUTTER

BACKGROUND

The present invention relates to an orifice for a high-pressure waterjet cutter. More specifically, the present invention relates to a diamond orifice for a high-pressure waterjet cutter.

High-pressure waterjet cutters are known, as are orifices for high-pressure waterjet cutters. High-pressure waterjet cutters typically include a housing, such as a tube, that directs pressurized water to an orifice. The orifice constricts the flow of pressurized water from the housing into a focused stream, and directs the focused stream through a further housing and bore and out of the waterjet cutter.

Some high-pressure waterjet cutters also include an inlet, disposed downstream of the orifice, that draws abrasive particles into the focused stream of water prior to the stream of water exiting the waterjet cutter. The abrasive particles facilitate and add to the cutting power of the focused stream of water exiting the waterjet cutter.

SUMMARY

In one construction, the invention provides an orifice for a high-pressure waterjet cutter including a first surface defining an inlet plane, a second surface defining an outlet plane, and an inner bore aligned along a flow axis and extending from the first surface to the second surface. The orifice also includes a first layer of polycrystalline diamond extending from the first surface to a plane between the inlet plane and the outlet plane, and a second, separate layer of polycrystalline diamond extending from the plane to the second surface. The first layer and the second layer are coupled to one another to define a single component. The second layer has material properties different than the first layer.

In another construction, the invention provides an orifice for a high-pressure waterjet cutter including a first surface defining an inlet plane, a second surface defining an outlet plane, and an inner bore aligned along a flow axis and extending from the first surface to the second surface. The orifice also includes a first layer of material extending from the first surface to a plane between the inlet plane and the outlet plane, and a second layer of material extending from the plane to the second surface. The first layer and the second layer are coupled to one another to define a single component. The first layer provides superior impact resistance when compared to the second layer. The second layer provides superior cavitation resistance when compared to the first layer. The second layer provides superior wear resistance when compared to the first layer.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Before proceeding, it should be noted that the term "high pressure" as used herein refers to pressure levels in excess of about 15,000 psi with systems operating at pressure levels over 100,000 psi possible. The extreme pressure levels used in water jet cutters makes the application of common low pressure components impossible or difficult.

Figure 1:
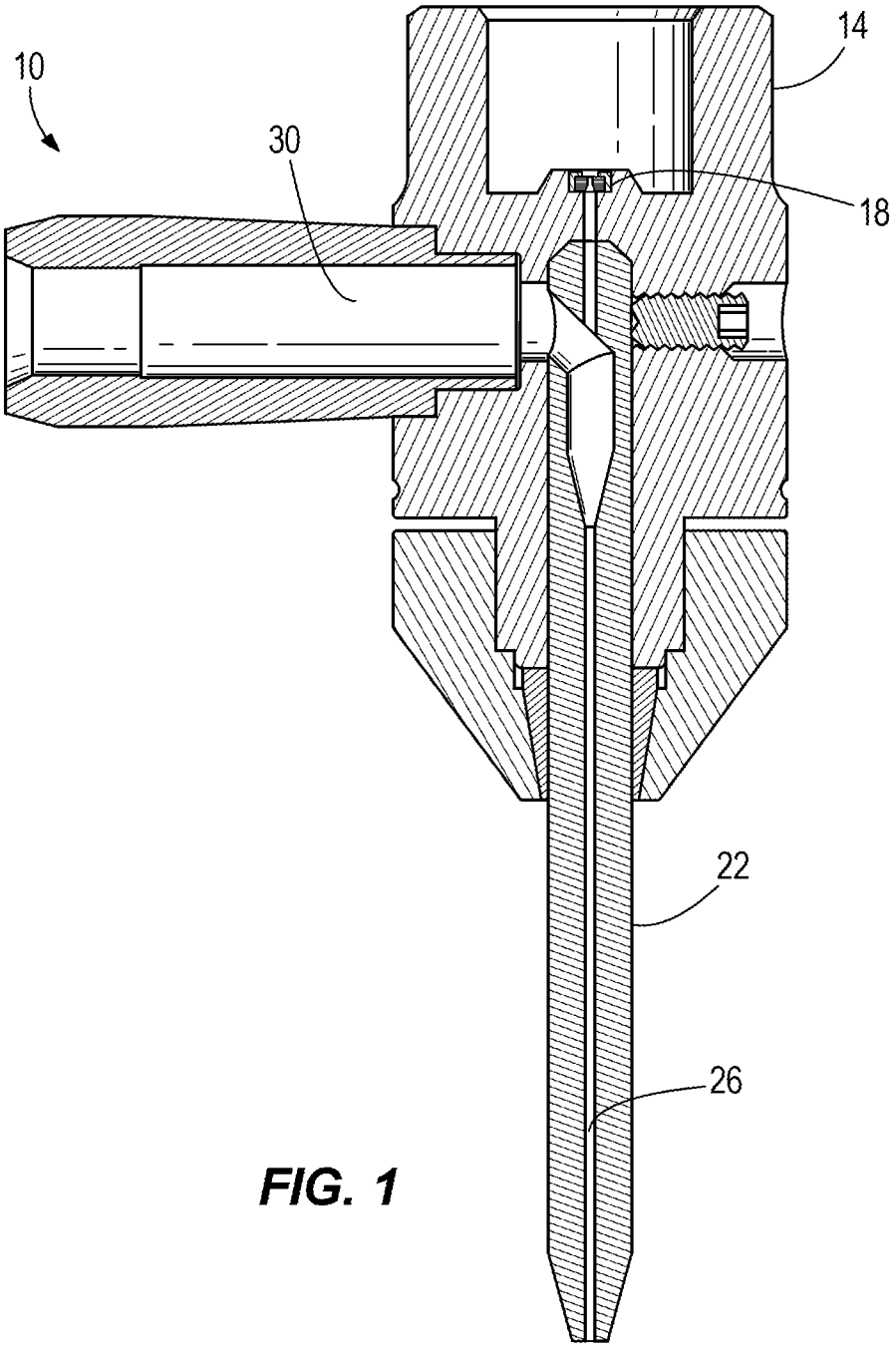
FIG. 1 is a section view of a portion of a high pressure waterjet cutter.

FIG. 1 illustrates a section view of a portion of a high-pressure waterjet cutter 10. The waterjet cutter 10 includes an upper housing 14 that delivers high-pressure water to an orifice assembly 18 disposed below the upper housing 14. The waterjet cutter 10 further includes a lower housing 22 disposed below the orifice assembly 18 that includes a bore 26. As the high-pressure water passes through the orifice assembly 18, the water is constricted and focused into a stream of water that passes through the bore 26 before exiting the waterjet cutter 10 at high speed. The extreme pressure is converted by the orifice into velocity. In some constructions, velocities well over Mach 1 are achieved. The extreme velocity results in a stream of water that can cut, erode or otherwise damage most materials commonly used to manufacture orifices for low pressure components.

As illustrated in FIG. 1, the waterjet cutter 10 further includes an inlet 30 that is in communication with the bore 26. As the stream of water passes through the bore 26, the water entrains abrasive particles disposed within the inlet 30 (i.e., small particulate matter disposed within a volume of air in the inlet 30) and pulls those particles into the stream of water. The particles facilitate and add to the cutting power of the focused stream of water exiting the waterjet cutter 10. In some constructions, the waterjet cutter 10 does not include the inlet 30 and does not entrain abrasive particles into the stream of water.

Figure 2:
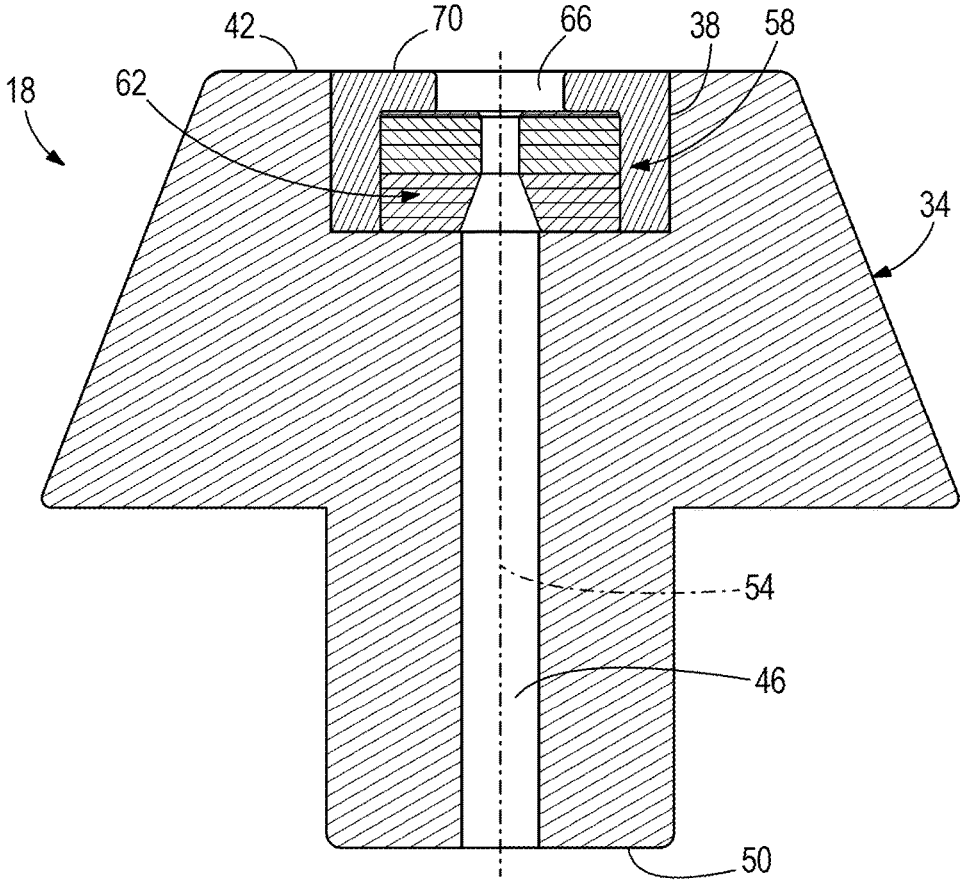
FIG. 2 is an enlarged section view of an orifice assembly according to one construction of the invention, including an orifice.

As illustrated in FIG. 2, the orifice assembly 18 includes a mount 34 having a cavity 38 disposed at a first end 42 of the mount 34, as well as an inner bore 46 extending from a second end 50 of the mount 34 to the cavity 38. The inner bore 46 is sized and configured to permit passage of water through the mount 34 from the first end 42 to the second end 50. The inner bore 46 is aligned along a flow axis 54.

The orifice assembly 18 further includes an orifice holder 58 and an orifice 62 both disposed within the cavity 38. The orifice holder 58 retains and holds the orifice 62 inside of the cavity 38. The orifice holder 58 includes an inner bore 66 that extends through a top portion 70 of the orifice holder 58 and is sized and configured to permit passage of water from above the orifice holder 58 to the orifice 62. The inner bore 66 is aligned along the flow axis 54.

Figure 3:
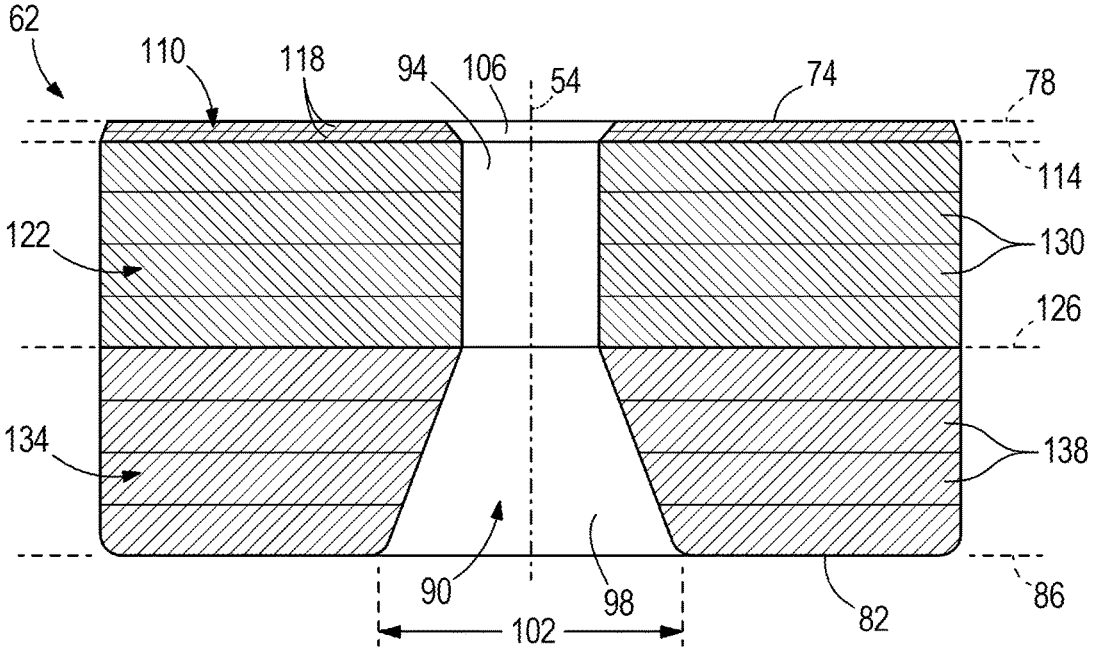
FIG. 3 is an enlarged section view of the orifice of FIG. 2.

With reference to FIG. 3, the orifice 62 includes a first surface 74 defining an inlet plane 78, a second surface 82 defining an outlet plane 86, and an inner bore 90 aligned along the flow axis 54 and extending from the first surface 74 to the second surface 82. The first surface 74 and the second surface 82 are parallel to one another, and the flow axis 54 is substantially normal to both the first surface 74 and the second surface 82. The inner bore 90 is sized and configured to permit passage of water from the inner bore 66 to the inner bore 46. The inner bore 90 includes a cylindrical portion 94 adjacent the inlet plane 78 and a frustoconical portion 98 extending from the cylindrical portion 94 to the outlet plane 86, the frustoconical portion 98 having a maximum diameter 102 at the outlet plane 86. The inner bore 90 further includes another, smaller frustoconical portion 106 extending from the cylindrical portion 94 to the inlet plane 78.

With continued reference to FIG. 3, the orifice 62 includes a first layer 110 of polycrystalline diamond extending from the first surface 74 to a first plane 114 between the inlet plane 78 and the outlet plane 86. The polycrystalline diamond is formed by sintering the diamond with a cobalt binder. In some constructions the polycrystalline diamond is binderless. Of course other materials or compounds could be employed as binders and other forming processes might be suitable for use. The first plane 114 is disposed at a transition between the frustoconical portion 106 and the cylindrical portion 94. The first layer 110 may include a plurality of sublayers 118 permanently bonded to one another or may be a single layer. In some constructions each sublayer 118 includes substantially the same material.

The orifice 62 includes a second, separate layer 122 of pseudo-monocrystalline diamond extending from the first plane 114 to a second plane 126 between the first plane 114 and the outlet plane 86. The second, pseudo-monocrystalline layer 122 may be a true monocrystalline layer, or may be a polycrystalline layer having a uniform make-up such that the layer has material properties similar to the material properties of a true monocrystalline layer or material properties that at least closely resemble that of a monocrystalline layer. The second plane 126 is disposed at a transition between the cylindrical portion 94 and the frustoconical portion 98, but could be positioned at other locations. The second layer 122 may include a plurality of sublayers 130 permanently bonded to one another or may be a single layer. In some constructions each sublayer 130 includes substantially the same material.

The orifice 62 includes a third, separate layer 134 of polycrystalline diamond extending from the second plane 126 to the second surface 82. The third layer 134 may include a plurality of sublayers 138 permanently bonded to one another or may be a single layer. In some constructions each sublayer 138 includes substantially the same material.

The first layer 110, the second layer 122, and the third layer 134 are permanently bonded to one another to define an inseparable single component. In some constructions the first layer 110, the second layer 122, and the third layer 134 are coupled to one another to form a single component but are not permanently bonded to one another. In some constructions the first layer 110 and the third layer 134 are made of the same material. In some constructions one or more of the first layer 110, the second layer 122, and the third layer 134 do not include any binders, as binders may sometime cause problems with cavitation.

In the illustrated construction the first layer 110 of polycrystalline diamond provides superior impact resistance when compared to the second layer 122 of pseudo-monocrystalline diamond. In some constructions the first layer 110 of polycrystalline diamond also provides superior impact resistance when compared to the third layer 134 of polycrystalline diamond. In the illustrated construction the second layer 122 of pseudo-monocrystalline diamond provides superior cavitation resistance when compared to the first layer 110 of polycrystalline diamond and the third layer 134 of polycrystalline diamond. In the illustrated construction the third layer 134 of polycrystalline diamond provides superior wear resistance when compared to the second layer 122 of pseudo-monocrystalline diamond. In some construction the third layer 134 of polycrystalline diamond also provides superior wear resistance when compared to the first layer 110 of polycrystalline diamond.

Figure 4:
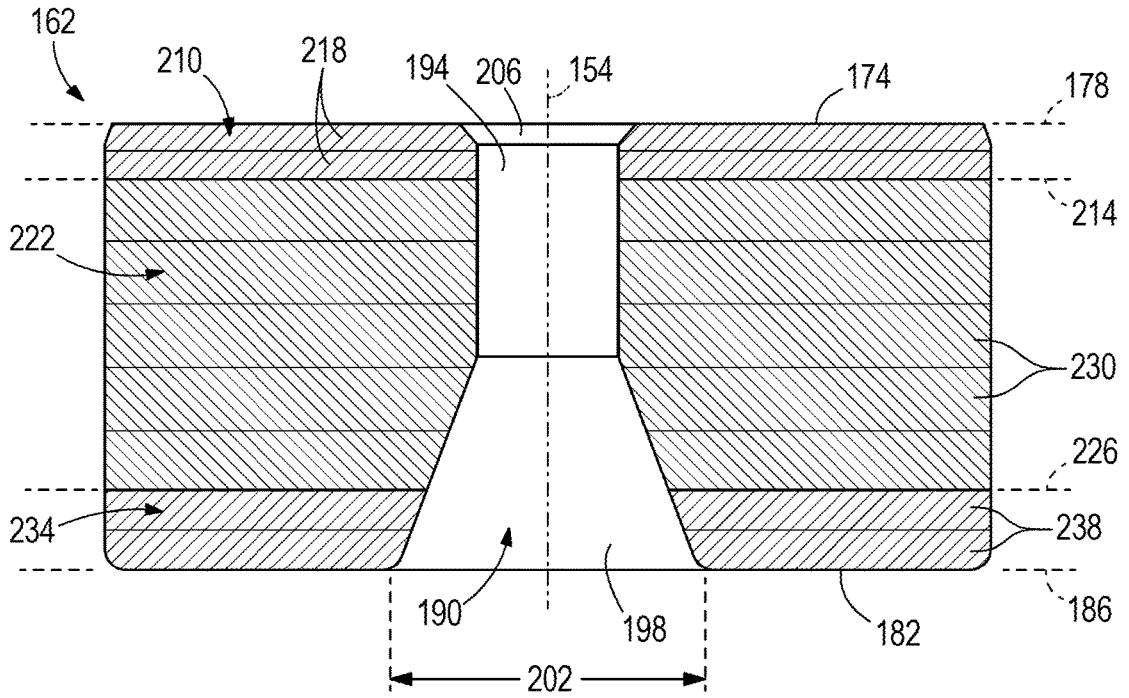
FIG. 4 is an enlarged section view of an orifice according to another construction of the invention.

FIG. 4 illustrates an orifice 162 according to another construction of the invention. The orifice 162 is substantially identical to the orifice 62 (i.e., includes a first surface 174, an inlet plane 178, a second surface 182, an outlet plane 186, an inner bore 190, a maximum diameter 202 of a frustoconical portion 198, a plurality of sublayers 218 of a first layer 210, a plurality of sublayers 230 of a second layer 222, and a plurality of sublayers 238 of a third layer 234) except that the location of a first plane 214 and a second plane 226 are different than the location of the first plane 114 and the second plane 126 in FIG. 3. As illustrated in FIG. 4, the first plane 214 is instead disposed along a cylindrical portion 194, below a transition between a frustoconical portion 206 and the cylindrical portion 194. The second plane 226 is disposed along the frustoconical portion 198, below the transition between the cylindrical portion 194 and the frustoconical portion 198. This arrangement of the first plane 214 and the second plane 226 provides the first layer 210 of polycrystalline diamond and the second layer 222 of pseudo-monocrystalline diamond each with a greater thickness (as measured along a flow axis 154), respectively, than the first and second layers 110, 122 illustrated in FIG. 3. This arrangement of the first plane 214 and the second plane 226 also provides the third layer 234 of polycrystalline diamond with a smaller thickness than the third layer 134 illustrated in FIG. 3.

Figure 5:
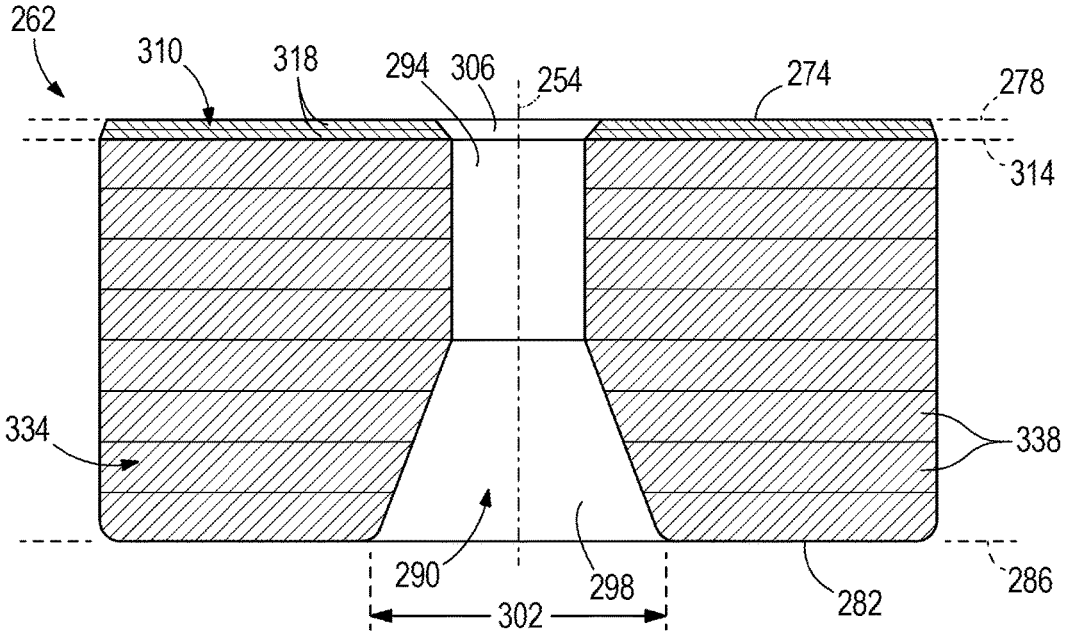
FIG. 5 is an enlarged section view of an orifice according to another construction of the invention.

FIG. 5 illustrates an orifice 262 according to another construction of the invention. As with the orifice 62 and 162, the orifice 262 similarly includes a flow axis 254, an inlet plane 278, an outlet plane 286, an inner bore 290, a frustoconical portion 298, and a maximum diameter 302 of the frustoconical portion 298. The orifice 262 includes only two layers of polycrystalline diamond, a first layer 310 of polycrystalline diamond and a second, separate layer 334 of polycrystalline diamond. The first and second layers 310, 334 are coupled to one another. In some constructions the first and second layers 310, 334 are permanently bonded together.

The first layer 310 extends from a first surface 274 to a plane 314 disposed at a transition between a frustoconical portion 306 and a cylindrical portion 294. The first layer 310 may include a plurality of sublayers 318 or may be formed from a single sublayer of material. In some constructions each sublayer 318 includes substantially the same material having the same material properties. In some constructions the sublayers 318 are permanently bonded to one another.

The second layer 334 extends from the plane 314 to a second surface 282. The second layer 334 may include a plurality of sublayers 338. In some constructions each sublayer 338 includes substantially the same material having the same material properties. In some constructions the sublayers 338 are permanently bonded to one another.

In one arrangement, the first layer 310 provides superior impact resistance when compared to the second layer 334. The second layer 334 provides superior cavitation resistance when compared to the first layer 310. The second layer 334 provides superior wear resistance when compared to the first layer 310.

In some constructions one or more physical properties of each sublayer is varied slightly to provide different material properties and a uniform transition between those material properties. For example, one construction may vary a particle size within each sublayer 318 and 338, thus providing a continuous change in material properties moving from the first surface 274 to the second surface 282.

Figure 6:
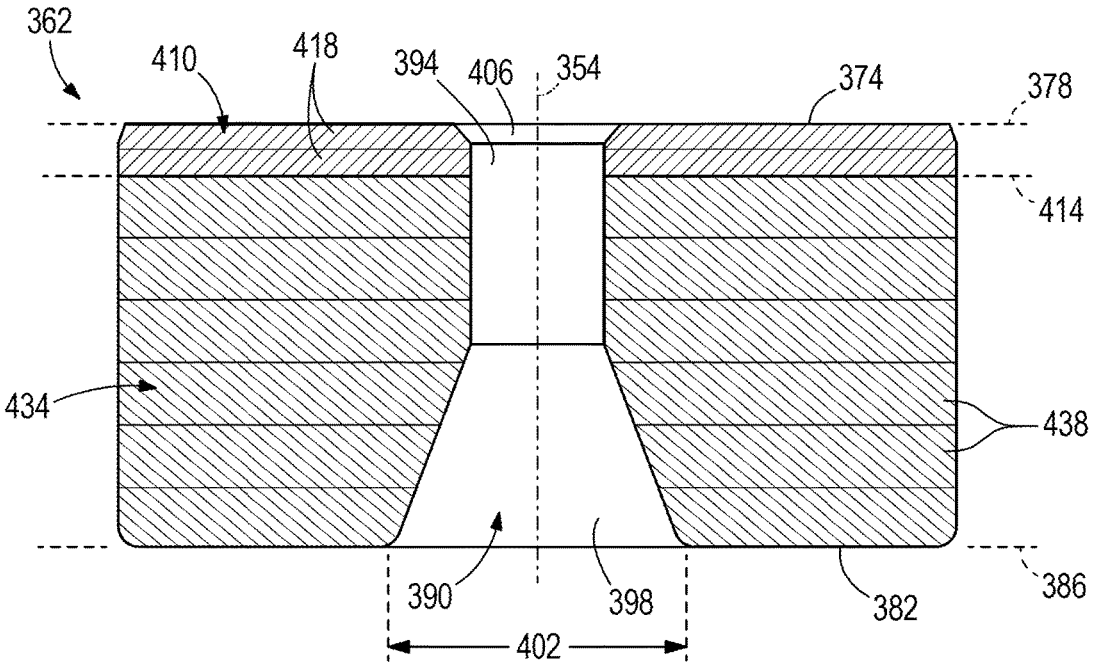
FIG. 6 is an enlarged section view of an orifice according to another construction of the invention.

FIG. 6 illustrates an orifice 362 according to another construction of the invention. The orifice 362 is substantially identical to the orifice 262 (i.e., includes a flow axis 354, a first surface 374, an inlet plane 378, a second surface 382, an outlet plane 386, an inner bore 390, a frustoconical portion 398 having a maximum diameter 402, a first layer 410 having sublayers 418, and a second layer 434 having sublayers 438), except that the location of the plane 414 is different than the location of the plane 314. As illustrated in FIG. 6, the plane 414 is instead disposed along a cylindrical portion 394, below a transition between a frustoconical portion 406 and the cylindrical portion 394. Thus, it should be clear that the plane 414 between the layers can be placed in positions other than those described.

The orifices 62, 162, 262, and 362 include various materials that provide desired material properties at different points within the orifices. The orifices include specific desired material properties at desired points of the orifices, unlike prior orifices manufactured from a single homogeneous material.

While four arrangements of an orifice are illustrated herein, the invention should not be limited to these four arrangements alone. For example, constructions with different bore arrangements or layer arrangements (e.g., more or fewer) are contemplated. In some constructions, the polycrystalline layers slowly transition to different arrangements axially along the bore. For example, a binder may be cobalt in a first sublayer of a polycrystalline layer and could slowly transition to a completely different binder at the last sublayer with sublayers therebetween being a combination of the two binders. In yet another arrangement, the layers are arranged circumferentially around the bore rather than axially along the bore. As one of ordinary skill in the art will realize, many arrangements of the multiple layers are possible.

The term "superior impact resistance" as used herein refers to an impact resistance (e.g., a fracture toughness as measured for example in Mpa) that is about 50% better, and preferably 2-3 times better, than a comparative impact resistance of another layer. The term "superior cavitation resistance" as used herein refers to cavitation resistance that is greater than a comparative cavitation resistance of another layer. For example, the illustrated second layer 122 of pseudo-monocrystalline diamond in FIG. 3 inherently has a superior cavitation resistance as compared to the first and third layers 110, 134 because the second layer 122 does not include binders, whereas the first and third layers 110, 134 include binders. The term "superior wear resistance" as used herein refers to a wear resistance that typically provides an increase in component life of at least 10 percent when the failure is due to wear.

Various features and advantages of the invention are set forth in the following claims.

The invention claimed is:

1. An orifice for a high-pressure waterjet cutter, the orifice comprising:

a first surface defining an inlet plane;

a second surface defining an outlet plane;

an inner bore aligned along a flow axis and extending from the first surface to the second surface;

a first layer of polycrystalline diamond extending from the first surface to a first plane between the inlet plane and the outlet plane, the first layer being sintered to define a continuous first component that extends the full width of the orifice, the width being measured in a direction normal to the flow axis;

a second, separate layer of polycrystalline diamond extending from a second plane to the second surface, the second layer being sintered to define a continuous second component that extends the full width of the orifice; and a third layer formed from a pseudo-monocrystalline diamond disposed between the first and second layers to define a third component, the first component, the second component, and the third component coupled to one another to define a single component, wherein the second component has material properties different than the first component, and wherein the inner bore includes a cylindrical portion adjacent the inlet plane and a frustoconical portion extending from the cylindrical portion to the outlet plane, the frustoconical portion having a maximum diameter at the outlet plane.

2. The orifice of claim 1, wherein the first surface and the second surface are parallel to one another, and wherein the flow axis is substantially normal to the first surface.

3. The orifice of claim 1, wherein the first component includes a plurality of sublayers permanently bonded to one another, and wherein each sublayer includes substantially the same material.

4. The orifice of claim 3, wherein the second component includes a plurality of sublayers permanently bonded to one another, and wherein each sublayer includes substantially the same material.

5. The orifice of claim 4, wherein each of the polycrystalline layers includes a plurality of diamond particles each having a particle size, and wherein the particle size within each sublayer of the first and second polycrystalline layers is different than a particle size in every other sublayer of the first and second layers.

6. The orifice of claim 1, wherein the first layer of polycrystalline diamond provides superior impact resistance when compared to the second layer of polycrystalline diamond.

7. The orifice of claim 1, wherein the second layer of polycrystalline diamond provides superior cavitation resistance when compared to the first layer of polycrystalline diamond.

8. The orifice of claim 1, wherein the second layer of polycrystalline diamond provides superior wear resistance when compared to the first layer of polycrystalline diamond.

9. The orifice of claim 1, wherein the orifice includes a third layer of pseudo-monocrystalline diamond disposed between the first and second layers to define a third component, the pseudo-monocrystalline layer having the material properties of a monocrystalline layer, the third layer having superior cavitation resistance when compared to both the first and the second layers of polycrystalline diamond.

10. The orifice of claim 9, wherein the first, second, and third layers do not include binders.

11. An orifice for a high-pressure waterjet cutter, the orifice comprising:

a first surface defining an inlet plane;

a second surface defining an outlet plane;

an inner bore aligned along a flow axis and extending from the first surface to the second surface;

a first layer of material extending from the first surface to a first plane between the inlet plane and the outlet plane, the first layer of material including a polycrystalline diamond material in a binder that defines a uniform first component, the first component defining a first portion of the inner bore that is frustoconical having a large diameter on the first surface;

a second layer of material extending from a second plane to the second surface, the second layer of material including a polycrystalline diamond material in a binder that defines a uniform second component, the second component defining a second portion of the inner bore that is frustoconical having a large diameter on the second surface; and a third layer formed from a pseudo-monocrystalline diamond disposed between the first layer and the second layer to define a third component, the third component defining a third portion of the inner bore that is cylindrical, the first component, the second component, and the third component coupled to one another to define a single component, wherein the first layer provides superior impact resistance when compared to the second layer, the second layer provides superior cavitation resistance when compared to the first layer, and the second layer provides superior wear resistance when compared to the first layer, wherein a fluid enters the orifice at the inlet plane at a pressure in excess of 15,000 psi and exits the orifice at the outlet plane at a velocity in excess of Mach 1, and wherein the inner bore is arranged to convert the inlet pressure to the outlet velocity.

12. The orifice of claim 11, wherein the first surface and the second surface are parallel to one another, and wherein the flow axis is substantially normal to the first surface.

13. The orifice of claim 11, wherein the inner bore includes a cylindrical portion adjacent the inlet plane and a frustoconical portion extending from the cylindrical portion to the outlet plane, the frustoconical portion having a maximum diameter at the outlet plane.

14. The orifice of claim 11, wherein the first component includes a plurality of sublayers permanently bonded to one another, and wherein each sublayer includes substantially the same material.

15. The orifice of claim 14, wherein the second component includes a plurality of sublayers permanently bonded to one another, and wherein each sublayer includes substantially the same material.

16. The orifice of claim 11, wherein the orifice includes a third layer of material that defines a third component disposed between the first component and the second component, the third layer having superior cavitation resistance when compared to both the first and the second layers.

17. The orifice of claim 16, wherein the third component includes pseudo-monocrystalline diamond disposed, the pseudo-monocrystalline layer having the material properties of a monocrystalline layer, the third layer having superior cavitation resistance when compared to both the first layer and the second layer.

* * * * *